US008454015B2

(12) United States Patent
Lai

(10) Patent No.: US 8,454,015 B2
(45) Date of Patent: Jun. 4, 2013

(54) PAPER INPUTTING APPARATUS

(75) Inventor: Yung-Cheng Lai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/305,818

(22) Filed: Nov. 29, 2011

(65) Prior Publication Data

US 2012/0261879 A1 Oct. 18, 2012

(30) Foreign Application Priority Data

Apr. 18, 2011 (TW) ..... 100113435 A

(51) Int. Cl.
*B65H 5/02* (2006.01)
*B65H 5/04* (2006.01)

(52) U.S. Cl.
USPC ..... 271/274; 271/273

(58) Field of Classification Search
USPC ..... 271/273, 274
See application file for complete search history.

(56) References Cited

U.S. PATENT DOCUMENTS

| | | | | |
|---|---|---|---|---|
| 3,241,665 | A * | 3/1966 | Erk | 209/577 |
| 5,988,635 | A * | 11/1999 | Ohshima | 271/274 |
| 7,427,065 | B2 * | 9/2008 | Maruyama | 271/273 |
| 2005/0184455 | A1 * | 8/2005 | Youn | 271/274 |
| 2007/0069456 | A1 * | 3/2007 | Jeong | 271/272 |
| 2008/0042340 | A1 * | 2/2008 | Linder et al. | 271/274 |
| 2008/0061499 | A1 * | 3/2008 | DeGruchy et al. | 271/273 |

FOREIGN PATENT DOCUMENTS

JP 04159940 A * 6/1992

* cited by examiner

*Primary Examiner* — Prasad Gokhale
(74) *Attorney, Agent, or Firm* — Altis Law Group, Inc.

(57) ABSTRACT

A paper inputting apparatus comprises a release soft roller shaft comprising an elastic member; a first soft roller shaft rotatably attached to the release soft roller shaft, the first soft roller shaft comprising an idler sleeve; wherein the elastic member abuts the first soft roller shaft; a second soft roller shaft comprising a soft roller; and a driving device attached to the release soft roller shaft; wherein the driving device rotates the release soft roller shaft and the first soft roller shaft between a first and a second positions relative to the second soft roller shaft; when in the first position, the idler sleeve abuts the soft roller, and the paper inputting apparatus grips a sheet of paper; when in the second position, a gap is defined between the idler sleeve and the soft roller, and the paper inputting apparatus releases the sheet of paper.

11 Claims, 4 Drawing Sheets

PAPER INPUTTING APPARATUS

BACKGROUND

1. Technical Field

The present disclosure relates to electronic devices, more particularly, to a paper inputting apparatus.

2. Description of Related Art

In general, an image forming device, such as a printer, a scanner, or a copier, includes a paper inputting unit, which receives sheets of paper and sequentially feeds the sheets of paper. The paper inputting unit may include a stop plate including a front part and a back part. The front part is attached to the back part by or with rubber damping element. A vibrating means is attached to the front part and the back part of the stop plate. However, the rubber damping element may become worn and loose, and take-ups of the sheets of paper may become unreliable. Therefore, there is room in the art for improvement.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
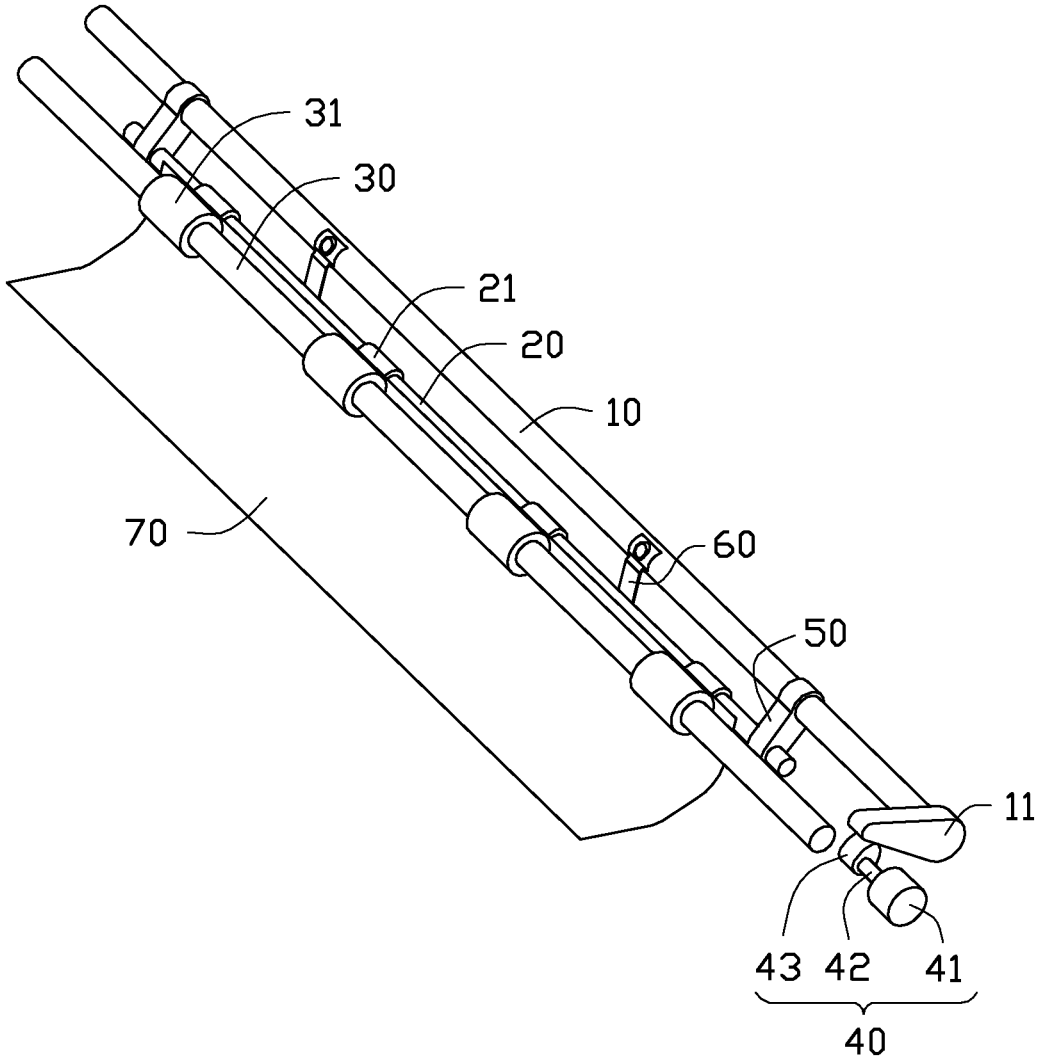
FIG. 1 is an exploded, isometric view of a paper inputting apparatus in accordance with an embodiment.
Figure 2:
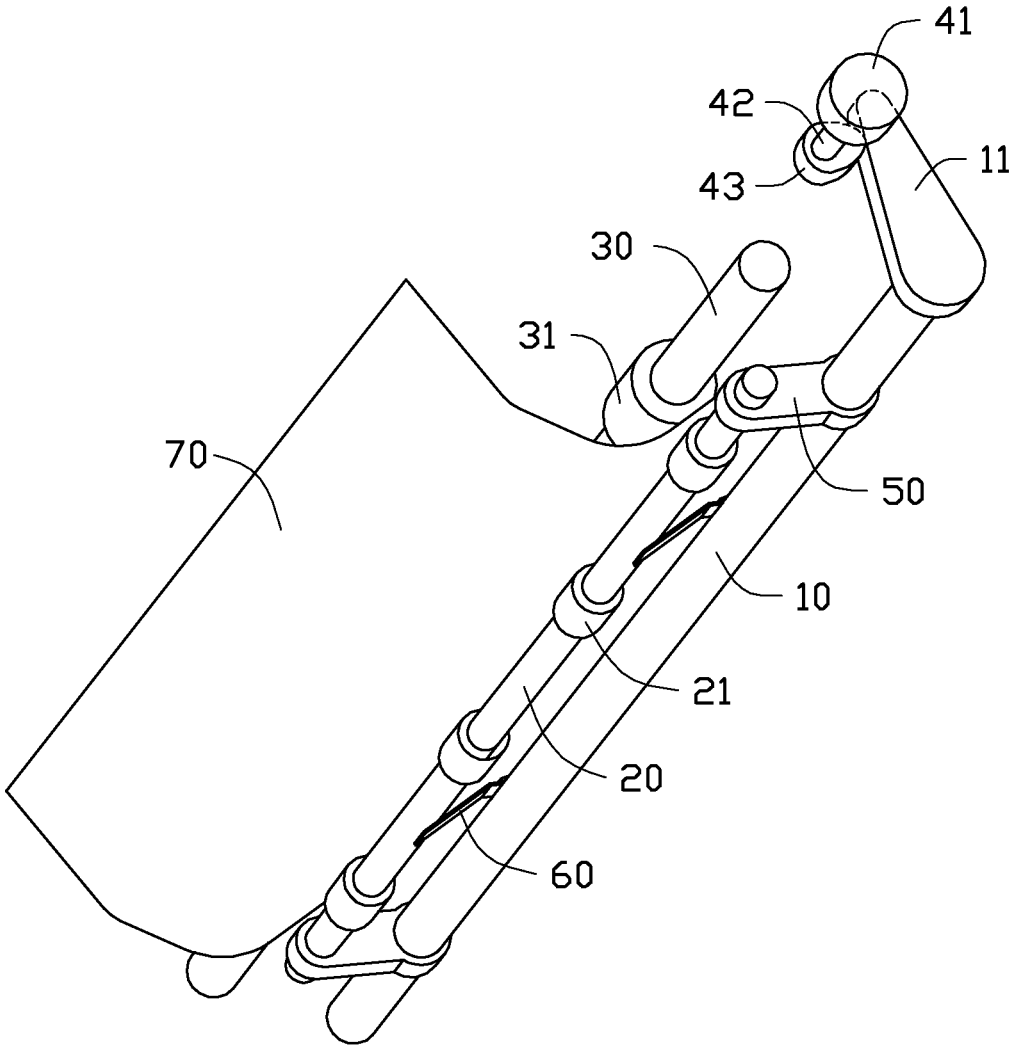
FIG. 2 is similar to FIG. 1, but viewed from a different aspect.

Referring to FIGS. 1 and 2, a paper inputting apparatus in accordance with an embodiment comprises a release soft roller shaft 10, a first soft roller shaft 20, a second soft roller shaft 30, and a driving device 40 engaged with the release soft roller shaft 10. The first soft roller shaft 20 is located below the release soft roller shaft 10 and the second soft roller shaft 30. In one embodiment, the paper inputting apparatus can be provided for a scanner, a printer, or the like.

The release soft roller shaft 10 comprises a swing arm 11 located on a free end of the release soft roller shaft 10. In one embodiment, the swing arm 11 is integrated with the release soft roller shaft 10. Two connecting members 50 are used to connect the release soft roller shaft 10 to the first soft roller shaft 20. In one embodiment, a first end of each of the two connecting members 50 is attached to the first soft roller shaft 20, and a second end of each of the two connecting members 50 is rotatably attached to the release soft roller shaft 10, so the first soft roller shaft 20 and the two connecting members 50 extend radially from the release soft roller shaft 10. Two elastic members 60 made of rectangular strips of resilient material having low-friction surfaces, are attached to the release soft roller shaft 10 by such means as, for example, jointing, belting or riveting.

A plurality of idler sleeves 21 are attached to the first soft roller shaft 20, and a plurality of soft rollers 31 are attached to the second soft roller shaft 30. In one embodiment, each of the plurality of idler sleeves 21 and each of the plurality of soft rollers 31 is made of latex or other soft, high-friction, material.

The driving device 40 comprises a driving member 41, a cam 43, and a transporting pole 42 connected to the driving member 41 and the cam 43. The driving member 41 may be a motor, for example. The cam 43 abuts the swing arm 11, and comprises a first part with a first radius and a second part with a second radius. The first radius is greater than the second radius.

Figure 3:
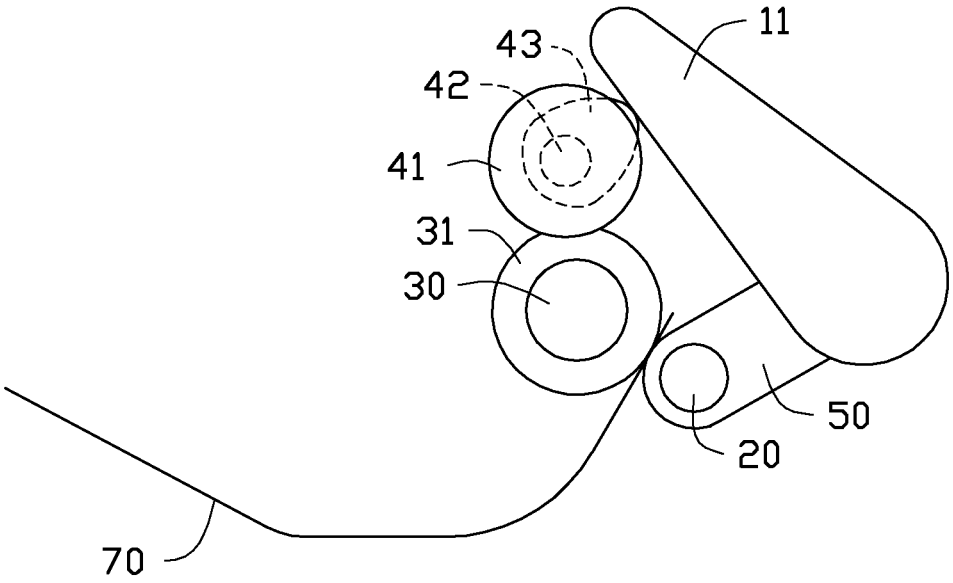
FIG. 3 is a side view of the paper inputting apparatus of FIG. 1, and shows a release soft roller shaft and a first soft roller shaft in a first position.
Figure 4:
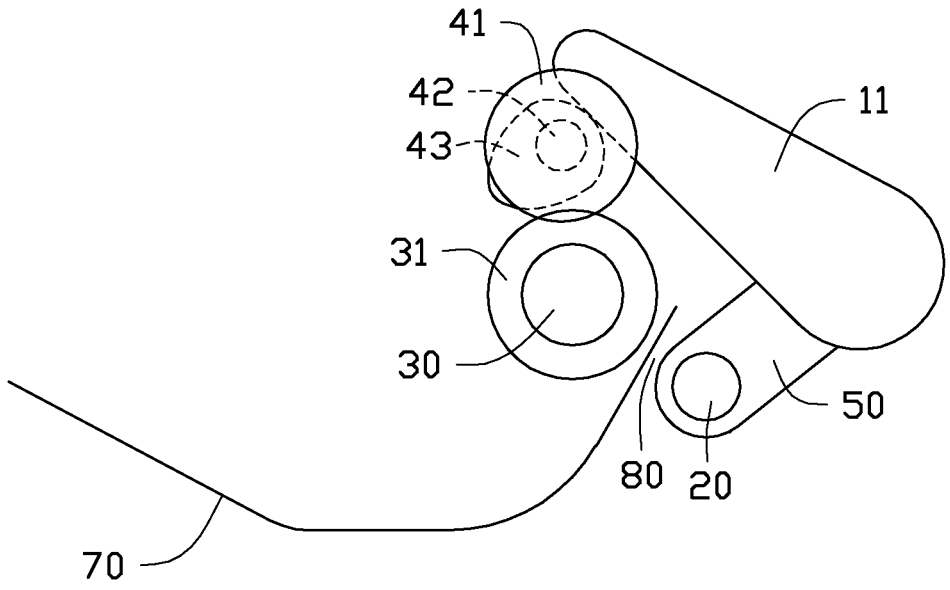
FIG. 4 is a similar to FIG. 1, but shows the release soft roller shaft and the first soft roller shaft in a second position.

The driving device 40 is capable of rotating the release soft roller shaft 10 and the first soft roller shaft 20 relative to the second soft roller shaft 30 between a first position as shown in FIG. 3 and a second position as shown in FIG. 4. In the first position, the first part of the cam 43 abuts the swing arm 11, and each of the plurality of idler sleeves 21 abuts each of the plurality of soft rollers 31. In the second position, the second part of the cam 43 abuts the swing arm 11, and a gap 80 is defined between the plurality of idler sleeves 21 and the plurality of soft rollers 31. In one embodiment, the two elastic members 60 exert a constant force against the first soft roller shaft 20 when the release soft roller shaft 10 and the first soft roller shaft 20 are located in the first position or the second position.

Referring to FIGS. 3-4, in use, the driving device 40, the release soft roller shaft 10, and the first soft roller shaft 20 are located in the first position. One sheet of paper 70 out of the plurality of sheets of paper is sandwiched between the first soft roller shaft 20 and the second soft roller shaft 30. In order to move the sheet of paper 70 forward from the first soft roller shaft 20 and the second soft roller shaft 30, the driving member 41 rotates the cam 43 to the second position. The second part of the cam 43 abuts the swing arm 11. When the cam 43 is rotated clockwise, the release soft roller shaft 10 is rotated anticlockwise. The two connecting members 50 and the first soft roller shaft 20 are rotated together relative to the release soft roller shaft 10. Therefore, the plurality of idler sleeves 21 and the plurality of soft roller 31 cooperatively define the gap 80 for the sheet of paper 70 to slide out of the paper inputting apparatus.

When the sheet of paper 70 is slid out of the paper inputting apparatus, the driving member 41 rotates the cam 43 from the second position to the first position. The first part abuts the swing arm 11, and each idler sleeve 21 abuts each soft roller 31. The first soft roller shaft 10 and the two connecting members 50 are rotated to the first position, and the two elastic members 60 abut the first soft roller shaft 20 to await a next sheet of paper.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A paper inputting apparatus comprising:

a release soft roller shaft comprising an elastic member;

a first soft roller shaft rotatably attached to the release soft roller shaft, the first soft roller shaft comprising an idler sleeve; wherein the elastic member abuts the first soft roller shaft;

a second soft roller shaft comprising a soft roller; and a driving device attached to the release soft roller shaft;

wherein the driving device rotates the release soft roller shaft and the first soft roller shaft between a first position and a second position relative to the second soft roller shaft; when the release soft roller shaft and the first soft roller shaft are in the first position, the idler sleeve abuts the soft roller, and the paper inputting apparatus is adapted to grip a sheet of paper between the idler sleeve and the soft roller; when the release soft roller shaft and the first soft roller shaft are in the second position, a gap is defined between the idler sleeve and the soft roller, and the paper inputting apparatus is adapted to release the sheet of paper between the idler sleeve and the soft roller;

the driving device comprises a cam having a first part with a first radius, and a second part with a second radius; the first radius is greater than the second radius; wherein when the release soft roller shaft and the first soft roller shaft are in the first position, the first part abuts the release soft roller shaft; and when the release soft roller shaft and the first soft roller shaft are in the second position, the second part abuts the release soft roller shaft.

2. The paper inputting apparatus of claim 1, wherein the elastic member is an elastic piece.

3. The paper inputting apparatus of claim 1, further comprising a connecting member, wherein a first end of the connecting member is attached to the first soft roller shaft, and a second end of the connecting member is rotatably attached to the release soft roller shaft.

4. The paper inputting apparatus of claim 1, wherein the release soft roller shaft comprises a swing arm, and the swing arm abuts the cam.

5. The paper inputting apparatus of claim 4, wherein the swing arm is integrated with the release soft roller shaft.

6. The paper inputting apparatus of claim 1, the driving device further comprises a driving member, and a transporting pole connected to the driving member and the cam; wherein the driving member rotates the cam by the transporting pole.

7. A paper inputting apparatus comprising:

a release soft roller shaft comprising an elastic member;

a first soft roller shaft comprising an idler sleeve, the elastic member being abutting the first soft roller shaft;

a connecting member; a first end of the connecting member is attached to the first soft roller shaft, and a second end of the connecting member is rotatably attached to the release soft roller shaft;

a second soft roller shaft comprising a soft roller; and a driving device attached to the release soft roller shaft;

wherein the driving device rotates the release soft roller shaft and the connecting member, the release soft roller shaft and the connecting member are rotatable between a first position and a second position; when the release soft roller shaft and the connecting member are in the first position, the idler sleeve abuts the soft roller, to clip a sheet of paper between the idler sleeve and the soft roller; when the release soft roller shaft and the connecting member are in the second position, the idler sleeve is moved away from the soft roller, a gap is defined is defined between the idler sleeve and the soft roller, to release the sheet of paper;

the driving device comprises a cam having a first part with a first radius, and a second part with a second radius; the first radius is greater than the second radius; wherein the first part and the second part abut the release soft roller shaft;

the driving device further comprises a driving member, and a transporting pole connected to the driving member and the cam; when the release soft roller shaft and the connecting member are in the first position, the first part abuts the release soft roller shaft; and when the release soft roller shaft and the connecting member are in the second position, the second part abuts the release soft roller shaft.

8. The paper inputting apparatus of claim 7, wherein the elastic member is an elastic piece.

9. The paper inputting apparatus of claim 7, wherein the elastic member is rectangular shaped.

10. The paper inputting apparatus of claim 7, wherein the release soft roller shaft comprises a swing arm, and the swing arm abuts the cam.

11. The paper inputting apparatus of claim 10, wherein the swing arm is integrated with the release soft roller shaft.

* * * * *